US012485937B2

(12) United States Patent
Bohme

(10) Patent No.: US 12,485,937 B2
(45) Date of Patent: Dec. 2, 2025

(54) CROSSING GATE MECHANISM WITH INTEGRATED COVER OR DOOR DETECTION SCHEME

(71) Applicant: Siemens Mobility, Inc., New York, NY (US)

(72) Inventor: Richard C. Bohme, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 839 days.

(21) Appl. No.: 17/654,897

(22) Filed: Mar. 15, 2022

(65) Prior Publication Data

US 2023/0294748 A1 Sep. 21, 2023

(51) Int. Cl.
*B61L 5/06* (2006.01)

(52) U.S. Cl.
CPC ..... *B61L 5/06* (2013.01)

(58) Field of Classification Search
CPC ..... B61L 5/06; B61L 29/00
See application file for complete search history.

(56) References Cited

U.S. PATENT DOCUMENTS 1,285,460 A * 11/1918 Swanson ..... B61L 29/284 246/126
1,560,085 A * 11/1925 Harvey ..... B61L 29/226 246/128
1,595,154 A * 8/1926 Harrison ..... B61L 29/226 49/93
6,307,339 B1 * 10/2001 Yourist ..... B61L 29/08 318/266
9,809,237 B2 * 11/2017 DeJarnatt ..... B61L 23/007
10,589,766 B2 * 3/2020 Wydotis ..... B61L 29/288
12,012,137 B2 * 6/2024 Fox ..... G01J 1/44
12,038,049 B2 * 7/2024 Bohme ..... F16C 43/02
12,065,180 B2 * 8/2024 Bohme ..... B61L 29/04
12,065,181 B2 * 8/2024 Spencer ..... B61L 29/04
12,095,401 B2 * 9/2024 Reed ..... G01L 5/26
2002/0090259 A1 * 7/2002 Crowley ..... E01F 15/003 404/6
2023/0294748 A1 * 9/2023 Bohme ..... B61L 5/06 246/114 A
2023/0399038 A1 * 12/2023 Bohme ..... B61L 27/53
2024/0059331 A1 * 2/2024 Young ..... H02P 23/14

FOREIGN PATENT DOCUMENTS

CA 3119726 A1 * 5/2020 ..... B61L 29/04
JP 2011256682 A * 12/2011
KR 102511729 B1 * 3/2023
KR 20230123074 A * 8/2023

* cited by examiner

*Primary Examiner* — Jason C Smith

(57) ABSTRACT

A crossing gate mechanism includes an enclosure housing multiple electric and electronic components with a control unit configured to operate the crossing gate mechanism and associated crossing gate arm, a cover for opening and closing the enclosure, wherein the cover is moveable between a closed position and an open position, wherein the enclosure houses a sensing device, wherein the cover includes a detectable device, and wherein the detectable device is arranged in the cover such that, when the cover is moved into the closed position, the detectable device comes in proximity to the at least one sensing device, and the sensing device is configured to indicate that the cover is in the closed position.

12 Claims, 5 Drawing Sheets

CROSSING GATE MECHANISM WITH INTEGRATED COVER OR DOOR DETECTION SCHEME

BACKGROUND

1. Field

Aspects of the present disclosure generally relate to railroad crossing gates and crossing gate mechanisms, more particularly, to a crossing gate mechanism with integrated cover or door detection scheme.

2. Description of the Related Art

A railway crossing, also referred to as level crossing or grade crossing, is an intersection where a railway line crosses a road or path. To ensure safety of railway crossings, crossing control systems including signal control equipment are installed at railway crossings. Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms, crossing lights (such as the red flashing lights often found at highway grade crossings in conjunction with the crossing gate arms), and/or crossing bells or other audio alarm devices. Constant warning time devices are typically configured to activate the crossing warning device (s) at a fixed time, also referred to as warning time (WT), which can be for example 30 seconds, prior to the approaching train arriving at the crossing.

Railroad crossing gates utilize electrical and mechanical components to ensure that the crossing gates perform their intended functions correctly. For example, gate arms are lowered using a motor located in a crossing gate mechanism, herein also referred to as gate control mechanism. A crossing gate mechanism may be described as gate control box housing multiple electric and electronic components for operating and controlling the signal control equipment and warning devices, such as the crossing gates. Typically, the gate control box includes a housing with a cover or door, so that the control box may be opened for maintenance or other services.

SUMMARY

Briefly described, aspects of the present disclosure generally relate to railroad crossing gates and, more particularly to a crossing gate mechanism with integrated cover or door detection functionality.

An aspect of the present disclosure provides an enclosure housing multiple electric and electronic components including a control unit configured to operate the crossing gate mechanism and associated crossing gate arm, a cover for opening and closing the enclosure, wherein the cover is moveable between a closed position and an open position, wherein the enclosure houses at least one sensing device, wherein the cover comprises a detectable device, and wherein the detectable device is arranged in the cover such that, when the cover is moved into the closed position, the detectable device comes in proximity to the at least one sensing device, and the at least one sensing device is configured to indicate that the cover is in the closed position.

Another aspect of the present disclosure provides a crossing gate system comprising one or more crossing gate arm(s), and a crossing gate mechanism comprising an enclosure housing multiple electric and electronic components, including a control unit, configured to operate the crossing gate mechanism and the one or more crossing gate arm(s), a cover for opening and closing the enclosure, wherein the cover is moveable between a closed position and an open position, wherein the enclosure houses at least one sensing device, wherein the cover comprises a detectable device, and wherein the detectable device is arranged in the cover such that, when the cover is moved into the closed position, the detectable device comes in proximity to the at least one sensing device, and the at least one sensing device is configured to indicate that the cover is in the closed position.

DETAILED DESCRIPTION

To facilitate an understanding of embodiments, principles, and features of the present disclosure, they are explained hereinafter with reference to implementation in illustrative embodiments. In particular, they are described in the context of a crossing gate mechanism utilized in connection with railroad crossing gate applications.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
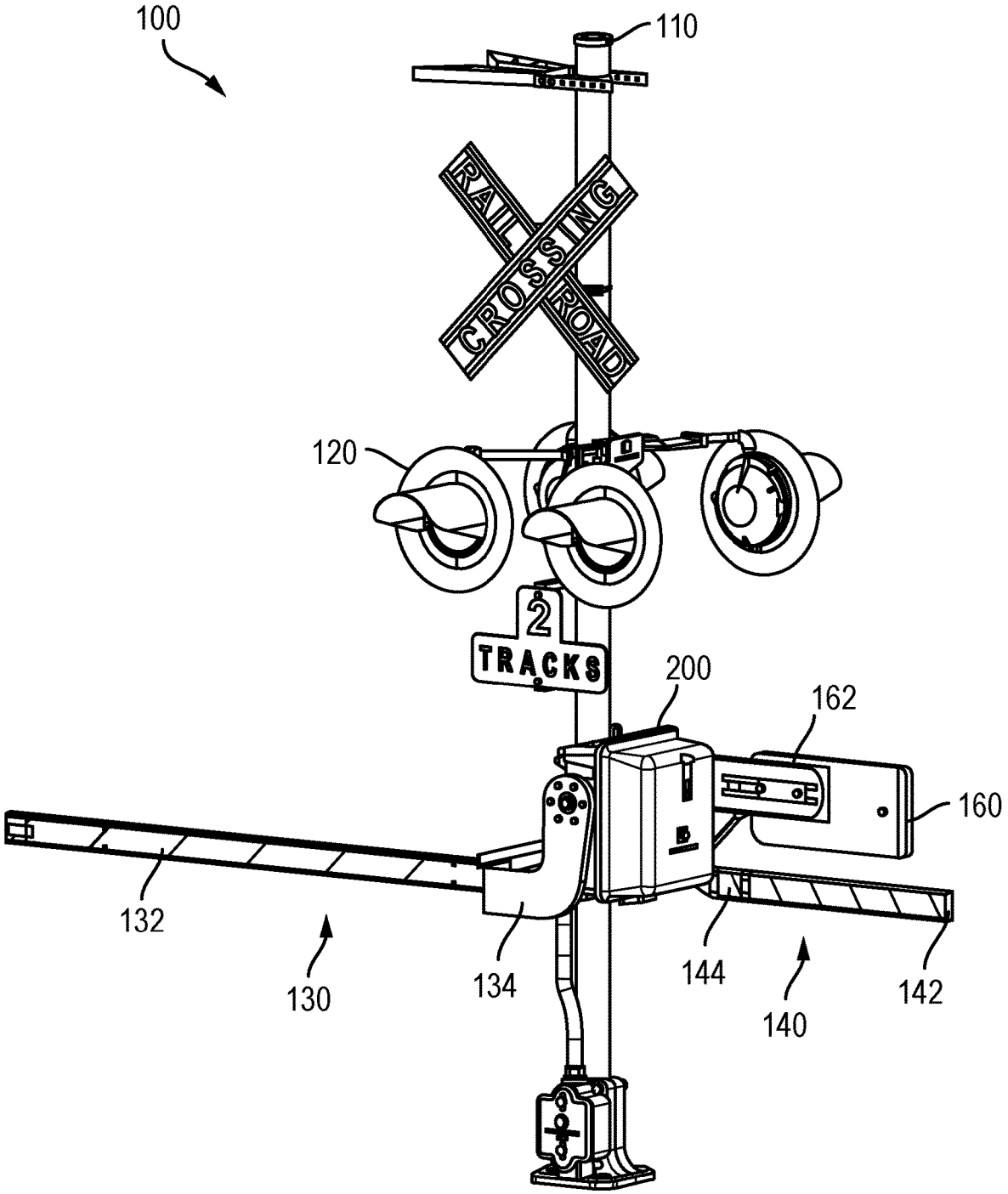
FIG. 1 illustrates an example railroad crossing gate in accordance with an exemplary embodiment of the present disclosure.

FIG. 1 illustrates a railroad crossing gate 100 in a lowered or horizontal position. At many railroad crossings, at least one railroad crossing gate 100 may be placed on either side of the railroad track to restrict roadway traffic in both directions. At some crossings, pedestrian paths or sidewalks may run parallel to the roadway. To restrict road and sidewalk traffic, the illustrated railroad crossing gate 100 includes a separate roadway gate 130 and pedestrian gate 140. The roadway gate 130 and pedestrian gate 140 may be raised and lowered, i. e. operated, by control mechanism 200.

The example railroad crossing gate 100 also includes a pole 110 and signal lights 120. The gate control mechanism 200 is attached to the pole 110 and is used to raise and lower the roadway and pedestrian gates 130, 140. The illustrated railroad crossing gate 100 is often referred to as a combined crossing gate. When a train approaches the crossing, the railroad crossing gate 100 may provide a visual warning using the signal lights 120. The gate control mechanism 200 will lower the roadway gate 130 and the pedestrian gate 140 to respectively restrict traffic and pedestrians from crossing the track until the train has passed.

As shown in FIG. 1, the roadway gate 130 comprises a roadway gate support arm 134 that attaches a roadway gate arm 132 to the gate control mechanism 200. Similarly, the pedestrian gate 140 comprises a pedestrian gate support arm 144 connecting a pedestrian gate arm 142 to the gate control mechanism 200. When raised, the gates 130 and 140 are positioned so that they do not interfere with either roadway or pedestrian traffic. This position is often referred to as the vertical position. A counterweight 160 is connected to a counterweight support arm 162 connected to the gate control mechanism 200 to counterbalance the roadway gate arm 132. Although not shown, a long counterweight support arm could be provided in place of the short counterweight support arm 134.

Typically, the gates 130, 140 are lowered from the vertical position using an electric motor contained within the gate control mechanism 200. The electric motor drives gearing connected to shafts (not shown) connected to the roadway gate support arm 134 and pedestrian gate support arm 144. The support arms 134, 144 are usually driven part of the way down by the motor (e.g., somewhere between 70 and 45 degrees) and then gravity and momentum are allowed to bring the arms 132, 142 and the support arms 134, 144 to the horizontal position. In another example, the support arms 134, 144 are driven all the way down to the horizontal position by the electric motor of the gate control mechanism 200.

Figure 2:
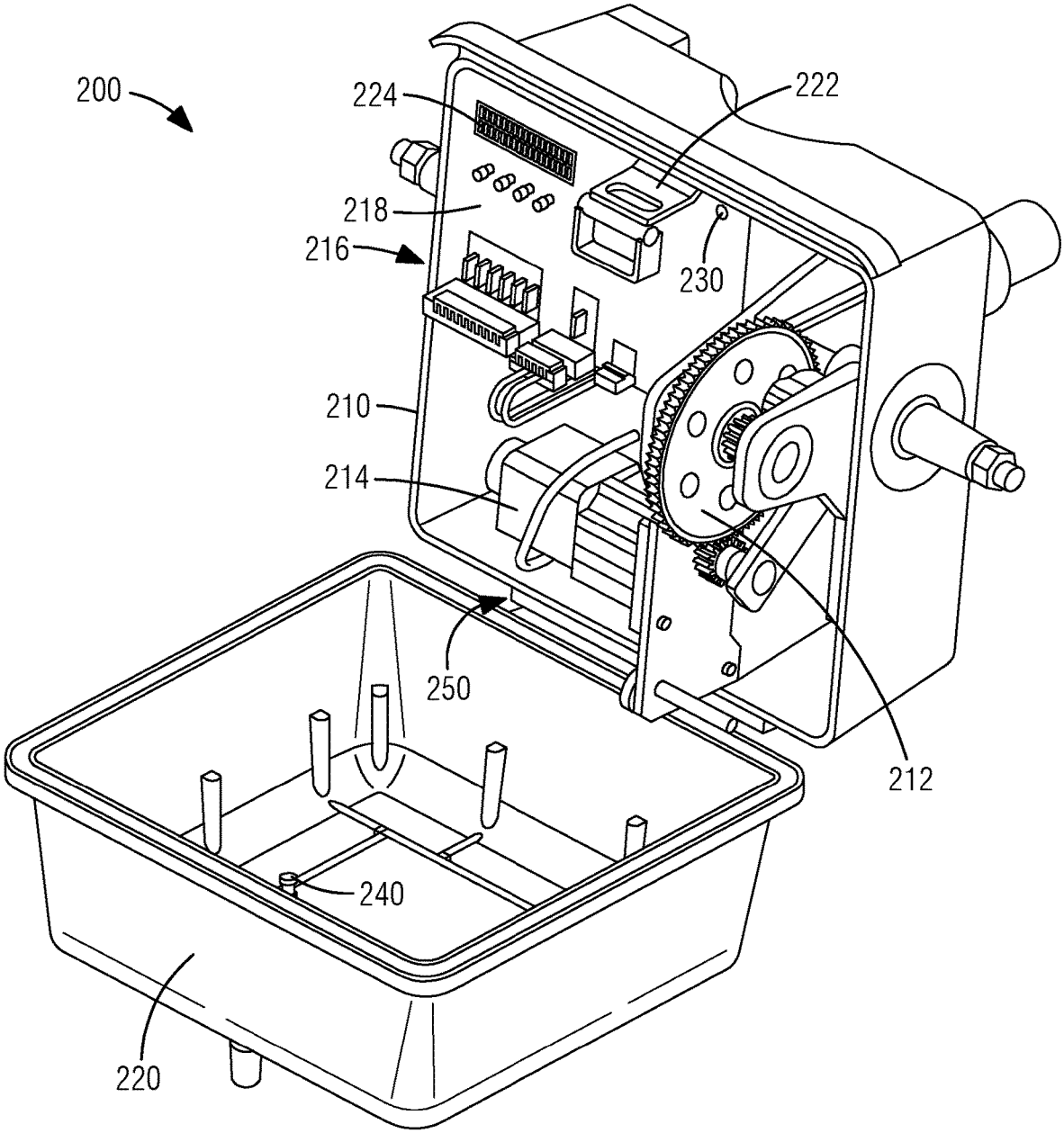
FIG. 2 illustrates a perspective view of a crossing gate mechanism in accordance with an exemplary embodiment of the present disclosure.

FIG. 2 illustrates a perspective view of crossing gate mechanism 200 in accordance with an exemplary embodiment of the present disclosure.

The crossing gate mechanism 200 comprises an enclosure 210 housing multiple electric and electronic components, such as for example gearing 212, electric motor 214 driving the gearing 212, and control unit 216. The control unit 216 comprises a printed circuit board (PCB) 218 with the necessary electronics for operating and controlling the gate mechanism 200 and associated crossing gate equipment, such as crossing gate arm(s), see for example FIG. 1. Further, the PCB 218 comprises for example display(s) and/or light emitting diodes (LEDs) 224, used for example to indicate or display status of the gate mechanism 200, such status including for example 'Power on', 'Gate Request', 'Brake On', 'Health' etc.

The enclosure 210 can be opened and closed via door or cover 220, for maintenance, repair, or other services. The cover 220 is moveable between a closed position and an open position, wherein FIG. 2 shows the cover 220 in the open position. The cover 220 is closed via hinge 250 and latch plate 222 in connection with a latch rod (not shown).

Currently, crossing gate mechanisms, sometimes also referred to as crossing gate box or grade control box, do not have a functionality that indicates whether the cover 220 is open or closed. Such a functionality or mechanism allows determination, for example by other railway equipment or railway personnel at another location, whether the cover 220 is in the correct state, for example closed when it is supposed to be closed, or open, for example when the crossing gate mechanism 200 is being serviced. If the cover 220 is not in the correct state, the control box 200 may be subject to vandalism or may have not been closed properly, wherein service personnel can then address this issue.

In an exemplary embodiment of the present disclosure, the crossing gate mechanism 200 comprises a cover detection feature or function that provides feedback with respect to the cover 220, specifically when the cover 220 is in the closed position.

One of the multiple components positioned in the enclosure 210 is at least one sensing device 230, and the cover 220 comprises a detectable device 240. The detectable device 240 is arranged in the cover 220 such that, when the cover 220 is moved into the closed position, the detectable device 240 comes in proximity to the at least one sensing device 230, which is then activated and configured to indicate that the cover 220 is in the closed position.

In an embodiment, the combination of the at least one sensing device 230 and detectable device 240 operate based on a magnetic field principle. The at least one sensing device 230 detects presence of a magnetic field. The at least one sensing device 230 comprises one or more sensor(s), for example Hall sensor(s), specifically a Hall sensor array. The detectable device 240 comprises a magnetized area with a magnetic field detectable by the at least one sensing device 230, such as the Hall sensor array. The at least one sensing device 230 may be arranged on the PCB 218. However, it should be noted that the at least one sensing device 230, for example Hall sensor array, may not be arranged on the PCB 218, but in another location within the enclosure 210 of the crossing gate mechanism 200. The detectable device 240, herein also referred to as magnetized device 240, can be configured as a bolt or pin, for example a magnetized bolt or pin. In an embodiment, the magnetized device 240 comprises a magnetized area in a head of the bolt or pin.

In other embodiments, the at least one sensing device 230 and detectable device 240 may not operate based on the magnetic field principle, but on different principles or modes. For example, the two devices 230, 240 may function together based on electrical or mechanical principles. The detectable device 240 provides a certain output or characteristic which is detectable or measurable by the at least one sensing device 230.

Figure 3:
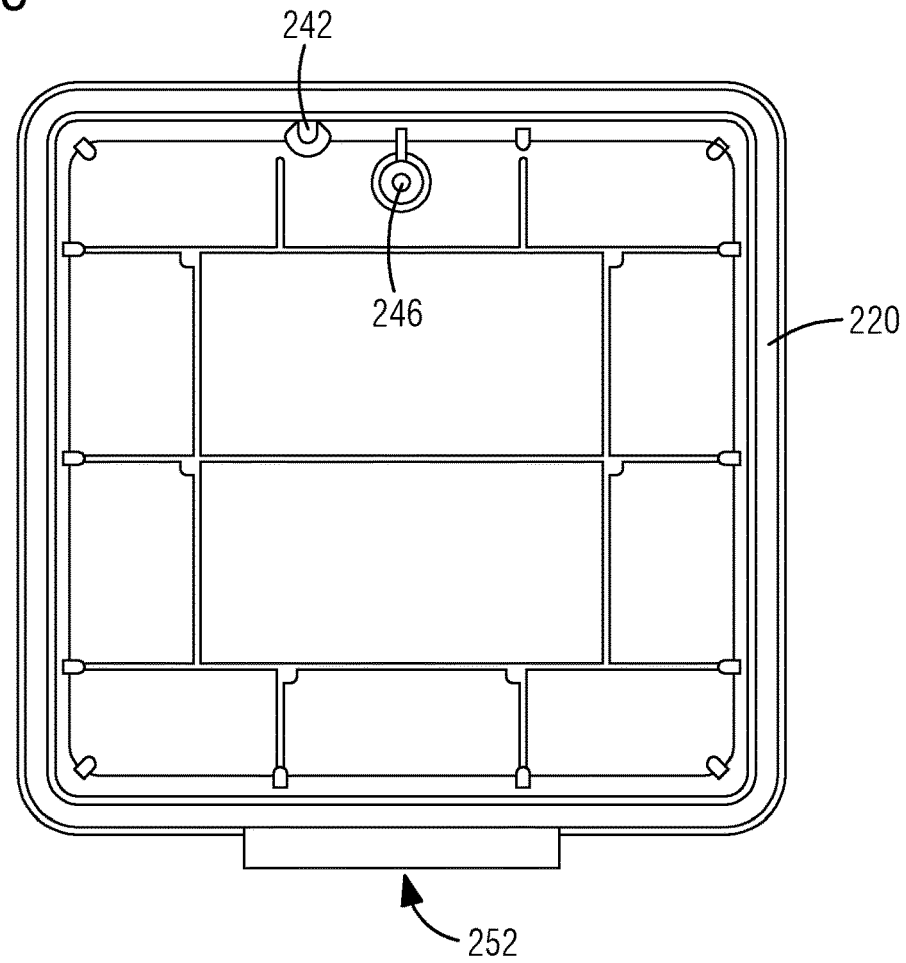
FIG. 3 and FIG. 4 illustrate different views of the cover in accordance with exemplary embodiments of the present disclosure.
Figure 4:
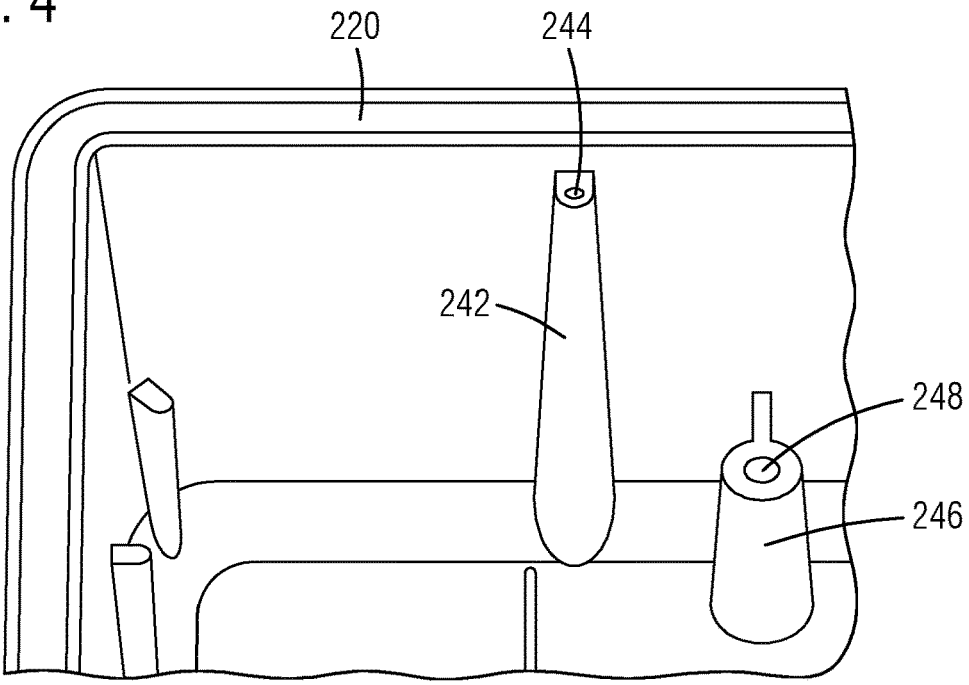

FIG. 3 and FIG. 4 illustrate different views of the cover 220 in accordance with exemplary embodiments of the present disclosure.

FIG. 3 illustrates a view of a 'raw' cover 220, specifically an inside of the cover 220. 'Raw' means that the cover 220 is shown in a manufacturing state, without being further processed (machined) into its final state. The cover 220 as well as the housing 210 are manufactured from metal, such as for example aluminum castings. When manufactured, the cover 220 includes protruding feature or raised boss 242 for receiving the magnetized device 240, and feature 246 for receiving a hatch rod (not shown) that is used for closing and securely connecting the cover 220 to the enclosure 210. Further, hinge area 252, including for example a hinge plate, is illustrated.

FIG. 4 illustrates a view of a section of a finalized cover 220, i. e. processed/machined into its final state. Raised boss 242 now comprises a threaded mounting hole 244 for inserting/receiving the magnetized device 240, e. g. magnetized bolt. Further, feature 246 comprises an opening/hole 248 for arranging a latch rod (not shown) to be operated with the latch plate 222 (see FIG. 1) of the enclosure 210.

Figure 5:
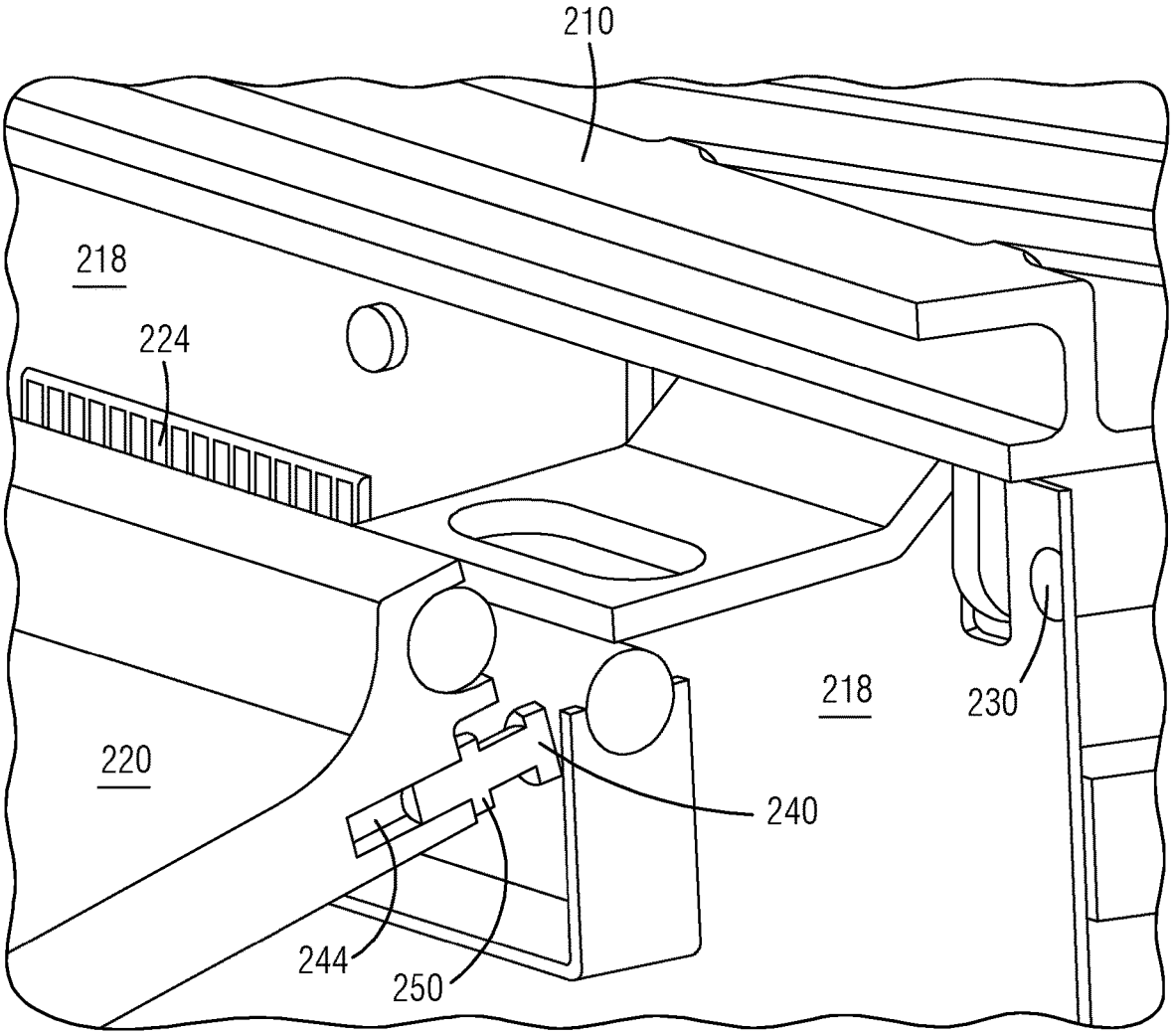
FIG. 5 illustrates a perspective view of a section of crossing gate mechanism in accordance with an exemplary embodiment of the present disclosure.

FIG. 5 illustrates a perspective view of a section of crossing gate mechanism 200 in accordance with an exemplary embodiment of the present disclosure.

With respect to FIG. 5, portions of the housing 210 and cover 220 are shown, wherein the cover 220 is in a nearly closed position. The PCB 218, which is part of the control unit 216 (see FIG. 1), comprises the at least one sensing device 230, e. g. Hall sensor array.

The cover 220 comprises mounting hole 244 with inserted magnetized device 240, e. g. magnetized bolt, and nut 250. Magnetized device 240, mounting hole 244 and nut 250 are illustrated in cross section. A predefined distance from a face (end) of the magnetized device/bolt 240 to a surface of the PCB 218 and thus the sensing device 230 integrated into the PCB 218 is set, and the nut 250 is tightened to act as a jam nut to hold a position of the magnetized device/bolt 240.

The threaded mounting hole 244 is designed such that the magnetized device 240 is adjustable and/or that different sizes/lengths of devices/bolts 240 can be mounted. That means that the mounting hole 244 is larger than the device 240. A proximity of the device/bolt 240 to the at least one sensing device 230 is adjustable, by moving (adjusting) the magnetized device 240 within the mounting hole 244.

The at least one sensing device 230, configured as Hall sensor array covers a predetermined area. The predetermined area is great enough to allow for different magnetized devices 240 and/or for more vertical and horizontal casting, machining and assembly variations and still ensures that the magnetized bolt 240 is within range of the target area of the sensor 230.

Figure 6:
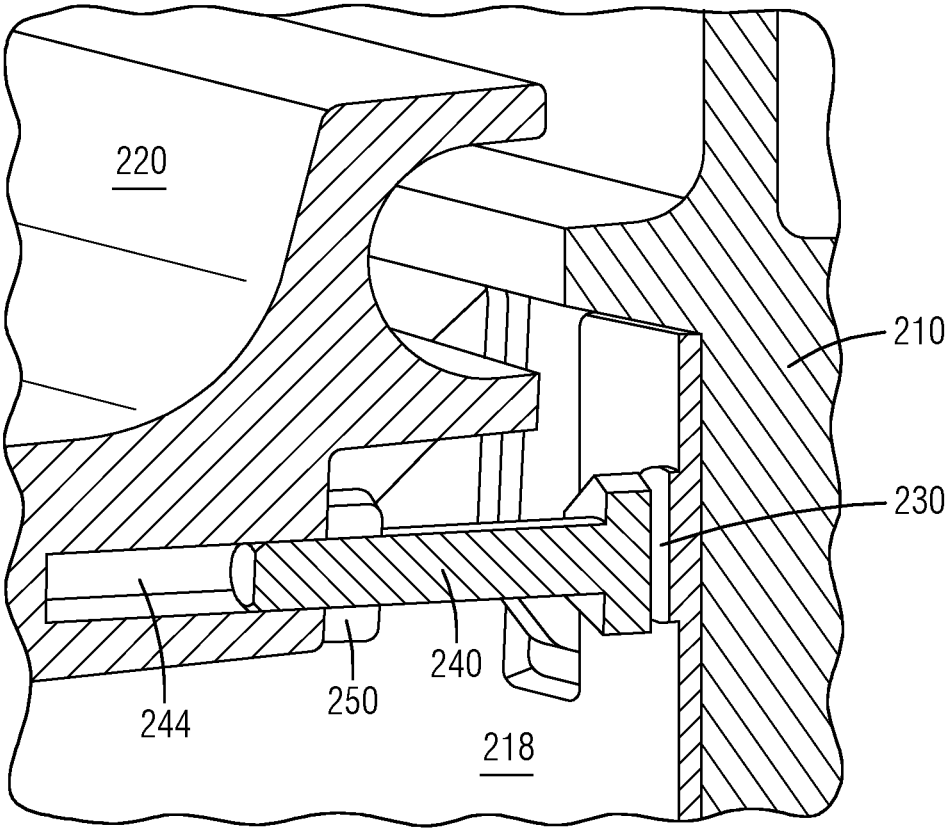
FIG. 6 illustrates another perspective view of a section of crossing gate mechanism in accordance with an exemplary embodiment of the present disclosure.

FIG. 6 illustrates another perspective view of a section of crossing gate mechanism 200 in accordance with an exemplary embodiment of the present disclosure.

Specifically, FIG. 6 illustrates the cover 220 in a closed position. The magnetized device 240 is near the sensing device 230, leaving a slight space between device 240 and sensor 230. When the cover 220 is in the closed position, the sensor 230, e. g. Hall sensor array arranged on PCB 218, is activated, and indicates that the cover 220 is closed.

In an embodiment of the present disclosure, the crossing gate mechanism 200, specifically control unit 216 with PCB 218, is configured to provide, output and/or transmit a signal to other railroad equipment that the cover 220 is closed. Based on the indication and output of the at least one sensing device 230, the control unit 216 provides or generates a signal that the cover 220 is closed. Since the at least one sensing device 230 is already mounted on the PCB 218 of the control unit 216, the signal of the sensing device 230 is readily available to the control unit 216.

The crossing gate mechanism 200 may have wired or wireless connections and/or communication links to other railroad equipment. For example, the crossing gate mechanism 200 may comprise a transmitter to wirelessly transmit a 'closed cover signal' to other railroad equipment or to a remote server or remote railway operating center using wireless networks, such as for example wireless LAN (over Internet access point), cellular/mobile network(s) or other radio technology, such as for example via cellular V2X or via standard LTE (3G/4G/5G). In another example, the crossing gate mechanism 200 may transmit a signal to other railroad equipment in close range via Bluetooth®. Such a transmitter may be integrated into the control unit 216 or may be a separate component within the gate mechanism 200.

In another embodiment, the control unit 216 may be configured to turn off the display and/or the LEDs 224 (see FIG. 5) when the cover 220 is in the closed position, to save energy/power of the gate mechanism 200. Further, the gate mechanism 200, utilizing for example the control unit 216, may be configured to maintain the cover 220 in the closed position and disable access to the crossing gate mechanism 200, for example to avoid unauthorized access to the gate mechanism 200. The access may be enabled when a repair or maintenance service is scheduled. Such a disablement/enablement may be activated remotely, for example via Bluetooth® connection.

Figure 7:
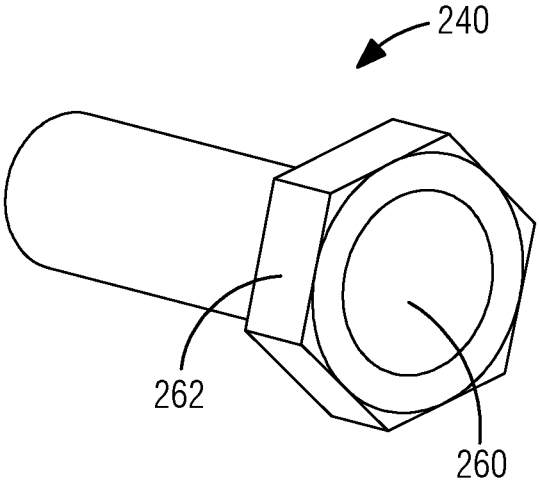
FIG. 7 illustrates a perspective view of a magnetized device in connection with a crossing gate mechanism in accordance with an exemplary embodiment of the present disclosure.

FIG. 7 illustrates a perspective view of magnetized device 240 in connection with a crossing gate mechanism 200 in accordance with an exemplary embodiment of the present disclosure. Magnetized device 240 is configured as bolt with a magnetized area 260. In an example, the magnetized area 260 is circular and located in head 262 of the bolt. The magnetized area 260 may be a circular magnet inserted into the head 262 of the bolt.

The described crossing gate mechanism 200 with integrated (closed) cover or door detection scheme offers an inexpensive and effective solution for determination and detection that the door or cover 220 is closed. Further, the solution allows for various casting and machining tolerances and variations of fixed mounted components, for example due to the adjustable magnetized device 240 of the cover 240. Further, the described gate mechanism 200 provides unauthorized access detection, power savings by turning off display(s) and/or LEDs 224 when the cover 220 is in the closed position, and/or access to the gate mechanism 200 can be disabled/enabled.

The invention claimed is:

1. A crossing gate mechanism comprising:

an enclosure housing multiple electric and electronic components including a control unit configured to operate the crossing gate mechanism and associated crossing gate arm, a cover for opening and closing the enclosure, wherein the cover is moveable between a closed position and an open position, wherein the enclosure houses at least one sensing device comprising a Hall sensor array, wherein the cover comprises a detectable device comprising a magnetized bolt having a magnetized area in a head of the bolt, and wherein the detectable device is arranged in the cover such that, when the cover is moved into the closed position, the detectable device comes in proximity to the at least one sensing device with an adjustable space therebetween, and the at least one sensing device is configured to indicate that the cover is in the closed position, and wherein the control unit is configured to generate and output a signal indicating that the cover is in the closed position when the Hall sensor array detects the magnetized area.

2. The crossing gate mechanism of claim 1, wherein the control unit comprises a printed circuit board (PCB), and wherein the Hall sensor array is arranged on the PCB, and wherein an active area of the Hall sensor array is greater than the magnetized area of the bolt.

3. The crossing gate mechanism of claim 1, wherein the magnetized bolt or pin comprises a circular magnet with a diameter, the magnet being arranged in a head of the bolt or pin.

4. The crossing gate mechanism of claim 1,
wherein the cover comprises a threaded mounting hole for receiving the detectable device.

5. The crossing gate mechanism of claim 4,
wherein the detectable device is securely mounted in the threaded mounting hole via a jam nut.

6. The crossing gate mechanism of claim 1, comprising:
a transmitter configured to transmit the signal that the cover is in the closed position to another system or device.

7. The crossing gate mechanism of claim 6,
wherein the transmitter is configured to wirelessly transmit the signal to the other system or device.

8. The crossing gate mechanism of claim 1, comprising:
a display and/or multiple light emitting diodes (LEDs), wherein the control unit is configured to turn off the display and/or the LEDs when the cover is in the closed position to conserve power.

9. The crossing gate mechanism of claim 1,
further configured to maintain the cover in the closed position and disable access to the crossing gate mechanism.

10. The crossing gate mechanism of claim 9,
wherein the control unit is configured to disable and enable the access based on a received communication signal.

11. The crossing gate mechanism of claim 10,
wherein the communication signal comprises a Bluetooth® signal.

12. A crossing gate system comprising:
one or more crossing gate arm(s), and
a crossing gate mechanism comprising:
an enclosure housing multiple electric and electronic components including a control unit configured to operate the crossing gate mechanism and associated crossing gate arm,
a cover for opening and closing the enclosure, wherein the cover is moveable between a closed position and an open position,
wherein the enclosure houses at least one sensing device comprising a Hall sensor array,
wherein the cover comprises a detectable device comprising a magnetized bolt having a magnetized area in a head of the bolt, and
wherein the detectable device is arranged in the cover such that, when the cover is moved into the closed position, the detectable device comes in proximity to the at least one sensing device with an adjustable space therebetween, and the at least one sensing device is configured to indicate that the cover is in the closed position, and
wherein the control unit is configured to generate and output a signal indicating that the cover is in the closed position when the Hall sensor array detects the magnetized area.

* * * * *